United States Patent [19]

Landers

[11] Patent Number: 4,981,237

[45] Date of Patent: Jan. 1, 1991

[54] ICE DISPENSER DOOR AND METHOD

[75] Inventor: Jerry Landers, Sellersburg, Ind.

[73] Assignee: SerVend International, Inc., Sellersburg, Ind.

[21] Appl. No.: 218,864

[22] Filed: Jul. 14, 1988

[51] Int. Cl.[5] ..... B67D 5/62; B67D 1/16

[52] U.S. Cl. ..... 222/1; 222/108; 222/146.6; 222/504; 62/344

[58] Field of Search ..... 222/108–110, 222/146.1, 146.6, 504, 1; 62/344

[56] References Cited

U.S. PATENT DOCUMENTS

| | | | |
|---|---|---|---|
| 3,021,035 | 2/1958 | Hill | 222/108 |
| 3,207,366 | 9/1965 | Feistel . | |
| 3,640,088 | 2/1972 | Jacobus et al. | 222/146.6 |
| 3,744,263 | 7/1973 | Franck et al. | 62/344 |
| 3,913,343 | 10/1975 | Rowland et al. . | |
| 3,916,949 | 11/1975 | Armstrong . | |
| 4,049,161 | 9/1977 | Kohl | 222/146.6 |
| 4,089,436 | 5/1978 | Marks . | |
| 4,090,641 | 5/1978 | Lindenschmidt . | |
| 4,139,126 | 2/1979 | Krasner et al. | 222/146.6 |
| 4,220,266 | 9/1980 | Braden et al. | 222/477 |
| 4,227,383 | 10/1980 | Horvay | 62/344 |
| 4,228,923 | 10/1980 | Barnard | 222/146.6 |
| 4,252,002 | 2/1981 | Mullins, Jr. | 62/344 |
| 4,254,896 | 3/1981 | Stanford et al. | 222/108 |
| 4,276,750 | 7/1981 | Kawasumi | 222/146.6 |
| 4,346,824 | 8/1982 | Miller et al. . | |
| 4,470,522 | 9/1984 | Lents et al. . | |
| 4,498,607 | 2/1985 | Jaschinski | 222/146.6 |
| 4,555,049 | 11/1985 | Mawby et al. | 222/146.6 |
| 4,676,405 | 6/1987 | Lents | 222/146.6 |
| 4,679,715 | 7/1987 | Hovinga . | |
| 4,787,539 | 11/1988 | Uchida et al. | 222/146.6 |

*Primary Examiner*—H. Grant Skaggs
*Assistant Examiner*—Steve Reiss
*Attorney, Agent, or Firm*—James Creighton Wray

[57] ABSTRACT

An ice dispensing apparatus having a storage bin with a paddle wheel which moves the ice from a storage bin to a delivery chute. An arcuate door is utilized to selectively open and close the delivery chute. A drip pan is provided on the outside of the chute to collected the melt water from the ice which is in the delivery chute.

25 Claims, 1 Drawing Sheet

ICE DISPENSER DOOR AND METHOD

BACKGROUND OF THE INVENTION

A problem of long standing in the ice dispensing field is ice spillage due to run over. The problem is universally recognized by persons adding ice to containers through automatic dispensing machines.

Usually when adding ice to a container before filling it with soft drink at a convenience store the container is pushed against a wire, lever, plate or button which starts the ice dispensing. Ice falls into the cup from a chute above the cup. When the desired amount of ice is obtained, the container is moved away from the wire, lever, plate or button. Ice continues to fall from the chute as the container is pulled away, dropping ice onto the pan beneath the chute. The long standing problem wastes ice, causes more ice than desired to flow into the container or requires special practice in partially withdrawing the container to release the switch before the desired amount of ice falls into the container and holding the container under the chute with the switch deactivated until the ice stops falling. The general problem is known in the field as ice spillage. The problem exists in filling cups with ice and in filling other containers such as ice buckets and bags from large dispensers of ice.

The problem has long existed without solution.

SUMMARY OF THE INVENTION

The present invention recognizes that the problem associated with spillage is really three major problems. One of the problems is the speed at which a door closes. If a door closes too slowly, the ice continues to flow during the closing.

A second problem is bad door design. A third problem is in flight ice.

In flight ice is the ice suspended in mid air that finds itself between the door and the cup when a customer decides that he has enough ice. The door closes, the cup is full, or is pulled away from the switch and the in flight ice spills into the drain pan. The present invention solves the three problems by providing a new rapidly acting door and by providing the door as close as possible to the cup. When the door closes the present invention has only one or two cubes of ice in flight. If the cup has not intentionally been filled to overflowing, those one or two cubes will drop into the cup before it can be fully withdrawn from beneath the chute.

The solving of the pre-existing problems by moving the door close to the cup creates a different problem. Ice housed behind the door waiting to be dispensed is now outboard of the insulated ice bin. That ice may start to melt before the next opening of the door and dripping may occur from the delivery chute.

The present invention solves that additional problem by providing a drip pan immediately beneath the door and draining water from the door drip pan to the main drain.

In a preferred ice dispensing apparatus ice is stored in an insulated ice storage means. A delivery chute is connected to the ice storage means. Motive means moves ice from the storage means to the delivery chute. A door means is connected to the delivery chute for controlling flow of ice out of the delivery chute.

Preferably, a door operator is a solenoid mounted above the delivery chute. The solenoid has a movable armature. An extension on the movable armature extends toward the delivery chute. A link is connected to an end of the extension distally from the solenoid. A door mounting plate has proximal and distal ends. Pivot means fixes the proximal end of the door mounting plate. A lug is connected to the door mounting plate near the proximal end and is connected to the link means for moving the door mounting plate with the link, extension and armature. A door is connected to a distal end of the door mounting plate and extends therefrom into a selective blocking arrangement with respect to the chute. The door is movable with the plate from a chute blocking condition to a chute opening condition.

Preferably, the door has a curvature centered on the pivot means. A curved surface of the door moves within a circular arc about the pivot means in response to movements of the armature.

Preferably, a drip collector means is connected to the chute on a side of the door remote from the ice storage means. Melt water from ice held in the chute by the door is collected by the drip collector.

A preferred collector has a ledge connected to a bottom of the chute external of the door and lower than the door. A collection pan is mounted beneath the ledge. The ledge drips water from melting ice held behind the door, and the collection pan collects water dripping from the ledge. A conduit is connected to the pan and to a drain for draining water from the pan.

The preferred apparatus has a frame mounted on the ice storage means adjacent the chute. The frame extends vertically above and below the chute. The drip collection pan is connected to a lower end of the frame.

Preferably, the pivot means is connected to a medial portion of the frame, and the solenoid is connected to an upper portion of the frame.

In a preferred embodiment, a vertically extending frame is mounted on the ice storage means adjacent the chute. The door has a door support having distal and proximal ends. A pivot connects a proximal end of the door support to a medial portion of the frame. A door plate extends into the chute from the distal end of the door support, and an actuator moves the door support.

Preferably, the actuator is a solenoid connected to an upper portion of the frame. An armature extends downward from the solenoid. A first end of a link is connected to a lower end of the armature. A lug is connected to the door support and to the second end of the link.

Preferably, the lug is mounted on the door support at a position closer to the proximal end than to the distal end. The door moves at a speed greater than the armature and over a distance greater than the armature.

A preferred ice dispenser discharge control apparatus has a chute having a receiving end and a discharge end, and having a downward sloping lower surface for gravitationally moving ice from the receiving end to the discharge end. A door is movable with respect to the chute between an open position remote from the sloped lower surface of the chute to a closed position in proximity to the sloped lower surface of the chute at the discharge end of the chute. Ice is blocked on the sloped lower surface of the chute when the door is in the closed position.

Preferably, a door operator is connected to the door. The door operator has a door support with proximal and distal ends. The door is connected to the door support at a distal end. Pivot means is connected to a proximal end of the door support for pivoting the door support. Moving means is connected to the door support for moving the door support.

Preferably, the moving means is connected to the door support at a position spaced a relatively short distance from the proximal end and a relatively large distance from the distal end, for moving the door at a relatively high speed and over a relatively great distance with respect to movement of the moving means.

Preferably, a frame is mounted adjacent the chute near the receiving end. The pivot is connected to the frame above the receiving end of the chute, and the moving means is connected to the frame above the pivot.

Preferably, the frame extends below the chute. A drip collection pan connected to a lower end of the frame extends beneath a lower end of the sloping lower surface of the chute for collecting drips of melt water from ice held in the chute by the door.

Preferably, the door is a curved plate which is curved on a radius centered approximately at an upper portion of the receiving end of the chute.

A preferred method of controlling the dispensing of ice comprises storing ice, delivering stored ice to the receiving end of a chute, opening a door at a discharge end of a chute and flowing ice out of the discharge end of the chute, closing the door at the discharge end of the chute, and trapping ice in the chute.

The preferred method further comprises collecting water melted from ice held within the chute and conducting the melt water to a drain.

In the preferred method the door opens upward and closes downward, by supporting a door on an outward end of a door support and pivoting the door support on an inward end near an upper portion of the receiving end of the chute, linking the door support to an actuator near the pivoted end and lifting and lowering the actuator for raising and closing the door.

Preferably, the method of opening and closing of the door comprises moving the door in a single arcuate path.

These and further and other objects and features of the invention are apparent in the disclosure which includes the above and ongoing specification and the claims and the drawings.

DETAILED DESCRIPTION OF THE DRAWINGS

Figure 1:
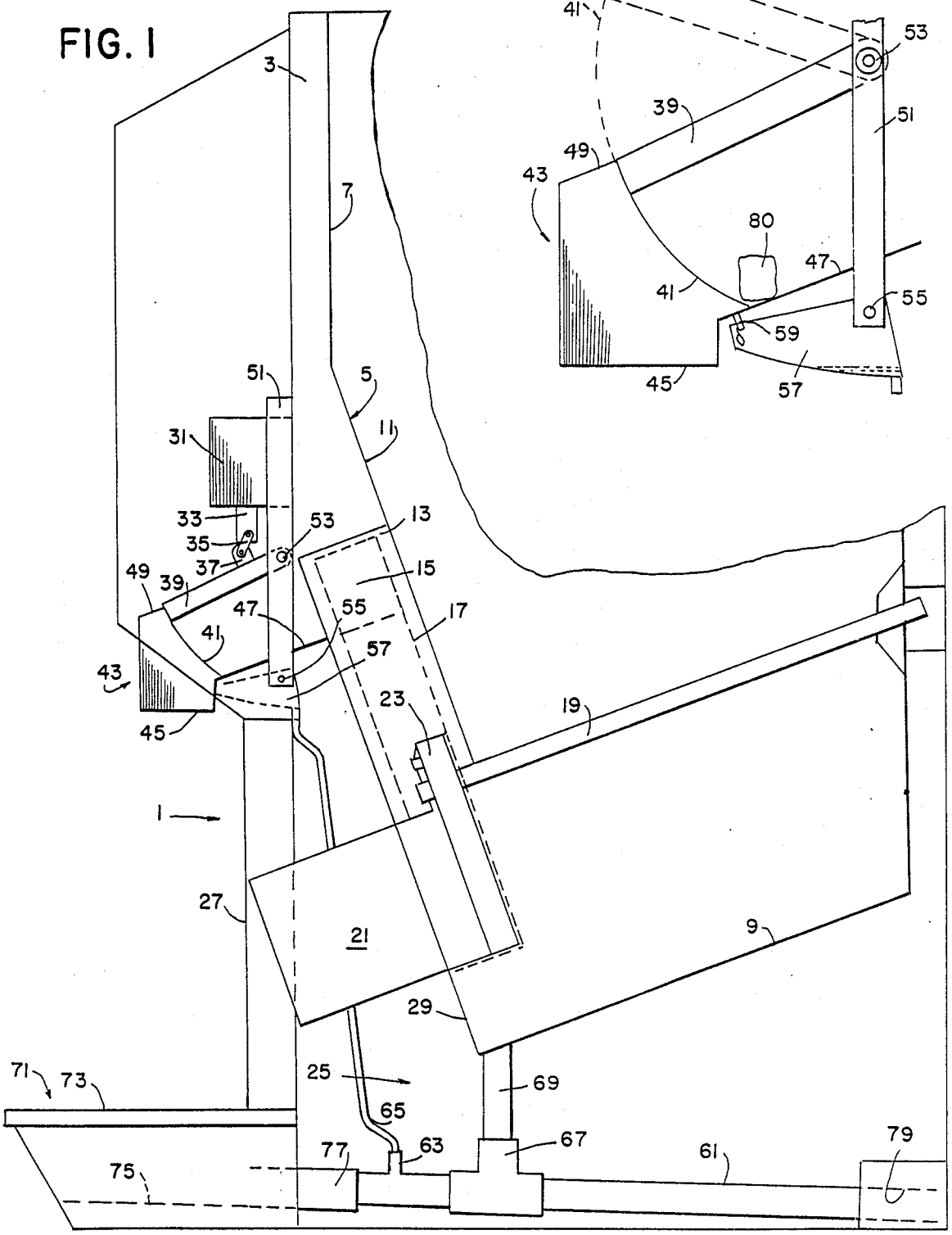
FIG. 1 is a schematic representation of a cross-section of an ice storage bin with a preferred paddle wheel ice elevator delivering ice to a chute which is controlled by a door of the present invention.

Referring to FIG. 1 an ice dispenser is generally indicated by the numeral 1. An insulated wall 3 generally surrounds a storage bin 5. The storage bin 5 has a vertical upper portion 7 of a forward wall. A lower wall 9 is sloped downward and rearwardly to attempt to move ice toward the lower sloped portion 11 of the front wall. A recess 13 in the lower portion of the front wall receives paddles 15 mounted on a paddle wheel 17.

The paddle wheel is in turn mounted on a shaft 19. The shaft 19 which drives the paddle wheel 17 extends rearward to a bearing in the rear wall. One or more angled arms may extend from the shaft 19 within the bin to break up ice jams. Shaft 19 and paddle wheel 17 are driven by the gears 23 attached to an integrated electric motor and gear combination 21. The motor 21 and gears 23 are mounted within a recess 25 formed in the lower portion of the front of the cabinet by virtue of the inward sloping of the lower portion 11 of the storage bin front wall, which provides sufficient volume to receive the motor 21 and gears 23 in a space between the outer facing 27 of the cup receiving area and the outer wall 29 of the storage bin. The particular motor and gear combinations positioning allows ease of access by simply removing the facing 27 from the cup receiving area.

The present invention has a vertically mounted solenoid 31 on the outside of the insulated wall 3. Solenoid 31 operates a piston 33 which moves a link 35 and lug 37 to lift and lower plate 39. An arcuate door 41 is attached to the plate 39 for selectively opening and closing the chute 43. The chute, generally indicated by the number 43, has an opening 45 positioned directly above a container which is intended to receive ice.

A switch, which is not shown, energizes solenoid 31 to open door 41 and turns on motor 21 to drive the paddle wheel 17. Ice is delivered to the chute 43 and falls through opening 45 into the container. The switch which is not shown may be a conventional lever positioned near facing 27 behind the container for contact by the container to start the motor and energize the solenoid, or the switch may be a push button switch located at a different position. The push button switch may be timed to provide power to the motor 21 and energize the solenoid 31 for a predetermined period of time which is related to a predetermined amount of ice. Alternatively the switch may be a coin-control switch which is operated for a predetermined period of time to provide a predetermined amount of ice in response to the deposit of a known amount of money.

As the paddle wheel 17 is driven, paddle wheels 15 deliver ice to the upper end of the chute 43 and ice slides down the lower wall 47. The upper wall 49 of the chute has an opening through which door 41 and its pivoted support plate 39 may move.

The entire door operating apparatus is mounted on a frame 51 connected to the wall of the ice storage bin 3. The door plate 39 is pivoted on pivot 53, which is at the center of curvature of door 41.

The door 41 may return to its closed state by gravitational force upon deactivation of solenoid 31 or solenoid 31 may be double acting to drive the door downward into the closed position by electromotive force or spring force. Preferably the current is removed from the solenoid when the door is closed.

Figure 2:
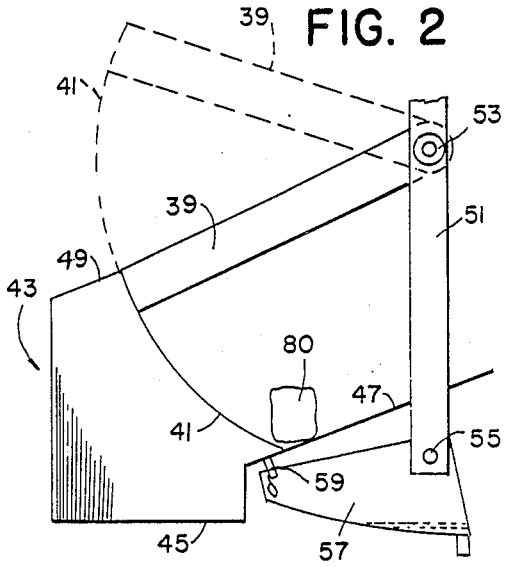
FIG. 2 is a detail of the chute, door and door drip pan of the present invention.

As best seen in FIG. 2, the door 41 pivots upwardly on plate 39 above the top 49 of the chute 43 when the door is open.

Because ice is trapped in back of the door 41 when it is closed and because that ice 80 is outside of the insulated area of the storage bin the ice may tend to melt over extended periods between dispensing operations.

To catch that melt, a fastener 55 at the bottom of frame 51 holds a drip pan 57 which collects the melt water from the ice 80 in chute 43. The melt water drips down along the lower wall 47 of the chute and drip ledge 59 causes the water to fall into the drip pan 57. That water flows into the main drain 61 through T 63 and tube 65. T 67 is connected to line 69 which drains the lower end of the front wall beneath the paddle wheel 17.

The container receiving pan 71 has a screen 73 for supporting the container and a drip pan 75 which is connected with connectors 77 to the main drain 61. Connector 79 provides a connection to a hose for permanent fitting to a collection drain.

As seen in the drawing the lug 37 is near the pivot point 53 of the door mounting plate 39 so that small rapid movements of the solenoid piston 33 move the door with rapid opening and closing movements. The curvature of the door 41 permits rapid movement through the ice and the positioning of the door near the bottom of the sloping wall 47 of the chute 43 reduces in flight ice. The drip pan 57 solves the new problem of ice which is held in the chute outside of the insulation of the storage bin.

While the invention has been described with reference to a specific embodiment, modifications and variations of the invention may be constructed without departing from the scope of the invention which is defined in the following claims.

I claim:

1. Ice dispensing apparatus, comprising ice storage means for storing ice, a delivery chute along which ice slides connected to the ice storage means, means for moving ice from the storage means to the delivery chute and a door opener and operator connected to the delivery chute for holding ice in the delivery chute and for controlling flow of ice out of the delivery chute, wherein the door opener and operator comprises: a solenoid mounted above the delivery chute, the solenoid having a movable armature, an extension on the movable armature extending toward the delivery chute, a link connected to an end of the extension distally from the solenoid, a door mounting plate having proximal and distal ends, pivot means for connecting the proximal end of the door mounting plate, a lug connected to the door mounting plate near the proximal end, and connected to the link for moving the door mounting plate with the link, extension and armature, a door connected to a distal end of the door mounting plate and extending therefrom into a blocking arrangement with respect to the chute and being movable with the plate from a chute blocking condition to a chute opening condition.

2. The apparatus of claim 1 wherein the door has a curvature centered on the pivot means whereby a curved surface of the door moves within a circular arc about the pivot means in response to movements of the armature.

3. Ice dispensing apparatus, comprising ice storage means for storing ice, a delivery chute along which ice slides connected to the ice storage means, means for moving ice from the storage means to the delivery chute and a door connected to the delivery chute for holding ice in the delivery chute and for controlling flow of ice out of the delivery chute, further comprising drip collection means connected to the chute on a side of the door remote from the ice storage means whereby melt water from ice held in the chute by the door is collected by the drip collection means.

4. The apparatus of claim 3 wherein the drip collection means comprises a ledge connected to a bottom of the chute external of the door and lower than the door and a collection pan mounted beneath the ledge whereby the ledge drips water from melting ice held behind the door and the collection pan collects water dripping from the ledge.

5. The apparatus of claim 4 further comprising conduit means connected to the pan and to a drain for draining water from the pan.

6. The apparatus of claim 5 further comprising frame means mounted on the ice storage means adjacent the chute, the frame means extending vertically above and below the chute and having a lower end and an upper end and wherein the drip collection pan is connected to a lower end of the frame means.

7. The apparatus of claim 6 wherein the pivot means is connected to a medial portion of the frame means.

8. The apparatus of claim 7 wherein the solenoid is connected to an upper portion of the frame means.

9. Ice dispensing apparatus, comprising ice storage means for storing ice, a delivery chute along which ice slides connected to the ice storage means, means for moving ice from the storage means to the delivery chute and a door connected to the delivery chute for holding ice in the delivery chute and for controlling flow of ice out of the delivery chute, further comprising a vertically extending frame mounted on the ice storage means adjacent the chute and wherein the door comprises door support having distal and proximal ends, a pivot connecting a proximal end of the door support to a medial portion of the frame and a door plate extending into the chute from the distal end of the door support and means for moving the door support.

10. The apparatus of claim 9 wherein the moving means comprises a solenoid connected to an upper portion of the frame, an armature extending downward from the solenoid, a link having first and second ends, a first end of the link connected to a lower end of the armature and a lug connected to the door support and connected to the second end of the link.

11. The apparatus of claim 10 wherein the lug is mounted on the door support at a position closer to the proximal end than to the distal end wherein the door moves at a speed greater than the armature and over a distance greater than the armature.

12. Ice dispenser apparatus comprising a chute having a receiving end and a discharge end and having a downward sloping lower surface for gravitationally moving ice on the lower surface from the receiving end to the discharge end and a door movable with respect to the chute between an open position remote from the sloped lower surface of the chute to a closed position in proximity to the sloped lower surface of the chute and on the sloped lower surface of the chute when the door is in the closed position, door operating means connected to the door, the door operating means having door supporting means with proximal and distal ends, the door being connected to the door supporting means at a distal end thereof and pivot means connected to a proximal end of the door supporting means for pivoting the door supporting means to allow pivoting of the door supporting means, and moving means connected to the door supporting means for moving the door supporting means, wherein the moving means is connected to the door supporting means at a position spaced a relatively short distance from the proximal end and a relatively large distance from the distal end for moving the door means at a relatively high speed and over a relatively great distance with respect to movement of the moving means.

13. The apparatus of claim 12 further comprising frame means mounted adjacent the chute near the receiving end thereof, the pivot means being connected to the frame means above the chute and the moving means being connected to the frame means above the pivot means.

14. The apparatus of claim 13 wherein the frame means extends below the chute and further comprising a drip collection pan connected to a lower end of the frame means and extending outward therefrom beneath a lower end of the sloping lower surface of the chute for collecting drips of melt water from ice held in the chute by the door means.

15. Ice dispenser apparatus comprising a chute having a receiving end and a discharge end and having a downward sloping lower surface for gravitationally moving ice on the lower surface from the receiving end to the discharge end and a door movable with respect to the chute between an open position remote from the sloped lower surface of the chute to a closed position in proximity to the sloped lower surface of the chute and on the sloped lower surface of the chute when the door is in the closed position, door operating means connected to the door, the door operating means having door supporting means with proximal and distal ends, the door being connected to the door supporting means at a distal end thereof and pivot means connected to a proximal end of the door supporting means for pivoting the door supporting means to allow pivoting of the door supporting means, and moving means connected to the door supporting means for moving the door supporting means, wherein the door comprises a curved plate which is curved on a radius centered approximately at an upper portion of the receiving end of the chute.

16. The method of controlling the dispensing of ice comprising storing ice, delivering stored ice to the receiving end of a stationary chute, opening a door at a discharge end of a chute and flowing ice out of the discharge end of the chute, closing the door at the discharge end of the chute, trapping ice in the chute, further comprising opening the door upward and closing the door downward by supporting a door on an outward end of a door support and pivoting the door support on an inward end near an upper portion of the receiving end of the chute, linking the door support to an actuator near the pivoted end and lifting and lowering the actuator for raising and closing the door, collecting water melted from ice held within the chute by the door and conducting the melt water to a drain.

17. The method of claim 16 wherein the opening and closing of the door comprises moving the door in a single arcuate path.

18. Ice dispenser apparatus, comprising an ice storage bin, a delivery chute connected to the bin for delivering ice from the bin, and a door positioned with respect to the chute for opening and permitting ice to flow along the chute and for closing and stopping ice in the chute, wherein said door comes into and out of contact with a portion of said sloped delivery chute on which ice slides.

19. The apparatus of claim 18, wherein said sloped delivery chute has an outlet, and wherein said door is located upstream of said outlet, immediately adjacent said sloped chute.

20. The apparatus of claim 18, wherein closing of the door stops inflight ice in the delivery chute.

21. Ice dispenser apparatus, having an ice storage bin and a sloped delivery chute connected to the bin for delivering ice from the bin, a movable door positioned adjacent the delivery chute for opening to allow ice to flow along the delivery chute and for closing to stop ice flowing in the chute, wherein said sloped delivery chute has an outlet and said door is located upstream of said outlet, immediately adjacent said sloped chute.

22. The apparatus of claim 21, wherein said door comes into and out of contact with a portion of said sloped delivery chute on which ice slides.

23. The apparatus of claim 21, wherein the door closes for stopping inflight ice on the delivery chute.

24. Ice dispensing apparatus, comprising an ice storage bin having an ice dispensing opening, an ice moving apparatus in the bin for moving ice to the dispensing opening, a sloped delivery chute having an upper inlet and connected to the ice dispensing opening for receiving ice from the ice dispensing opening, and a door mounted adjacent the sloped chute at a position remote from the inlet end for closing and stopping inflight ice on the delivery chute, wherein said door comes into and out of contact with a portion of said sloped delivery chute in which ice slides.

25. The apparatus of claim 24, wherein said sloped delivery chute has an outlet and said door is located upstream of said outlet, immediately adjacent said sloped chute.

* * * * *